United States Patent [19]

Delepine

[11] Patent Number: 4,513,458

[45] Date of Patent: Apr. 30, 1985

[54] FLOW SPOUT FOR LIQUID

[76] Inventor: Jean C. Delepine, 23 rue Clapeyron, 75008 Paris, France

[21] Appl. No.: 613,256

[22] Filed: May 23, 1984

[30] Foreign Application Priority Data

Jun. 24, 1983 [FR] France ..... 83 10480

[51] Int. Cl.[3] ..... E03C 1/04

[52] U.S. Cl. ..... 4/192; 4/191; 4/661

[58] Field of Search ..... 4/191, 192, 661, 195, 4/591

[56] References Cited

U.S. PATENT DOCUMENTS

| | | | |
|---|---|---|---|
| 1,383,886 | 7/1921 | Webb, Sr. | 4/192 |
| 1,406,030 | 2/1922 | Kelly | 4/192 |
| 1,408,375 | 2/1922 | Manelis | 4/192 |
| 1,417,583 | 5/1922 | Stratton | 4/192 |
| 1,512,193 | 10/1924 | Berven | 4/591 |
| 2,679,652 | 6/1954 | Eyring | 4/591 X |
| 2,993,213 | 7/1961 | Carroll | 4/591 |
| 4,231,123 | 11/1980 | Cheng | 4/591 X |
| 4,334,328 | 6/1982 | Delepine | 4/191 |

FOREIGN PATENT DOCUMENTS

| | | | |
|---|---|---|---|
| 2219893 | 12/1972 | Fed. Rep. of Germany | 4/192 |
| 740490 | 1/1933 | France | 4/192 |
| 161778 | 5/1933 | Switzerland | 4/192 |
| 201451 | 8/1923 | United Kingdom | 4/591 |
| 576928 | 4/1946 | United Kingdom | 4/192 |

*Primary Examiner*—Henry K. Artis

*Attorney, Agent, or Firm*—Fisher, Christen & Sabol

[57] ABSTRACT

The present invention relates to a flow spout comprising a wide flat chamber in sheet form, in which at least one liquid inlet opens out and which is in communication with the outside by a long, narrow slot. According to the invention, the flow spout comprises a concave curved surface constituted at least in part by generatrices parallel to one another and disposed so that its generatrices are at least approximately horizontal and its rear edge is at a level higher than its front edge, and said wide flat chamber is arranged so that its long, narrow slot is disposed on the rear edge side, close to said concave curved surface and at least substantially parallel to said generatrices.

10 Claims, 6 Drawing Figures

FLOW SPOUT FOR LIQUID

The present invention relates to a flow spout connected to at least one liquid inlet. It is particularly, but not exclusively, adapted for use as a spout for filling a bath tub.

Known spouts for filling ball tubs are known to deliver a jet of water of substantially circular section. This results in the filling operation being noisy.

U.S. Pat. No. 4,334,328 describes a flow spout which overcomes this drawback and which, to this end, is noteworthy in that it comprises a wide flat chamber in sheet form, in which at least one liquid inlet opens out and which is in communication with the outside via a long, narrow slot.

The jet emitted by the flow spout is thus in the form of a curtain, which makes it less noisy to fill a bath tub. Furthermore, the flow spout does not require an anti-splash nozzle, with the result that it is less sensitive to furring than the known spouts.

In an advantageous embodiment of this known flow spout, the slot is defined between two parallel plates rendered hermetically fast with each other over the whole of their periphery, except at the location of the slot and these plates are disposed substantially horizontally, the upper plate serving as support of the shelf type. The edge of the plates adjacent the slot is advantageously curved downwardly, in order to direct the curtain towards a bath tub to be filled.

A convex curtain or sheet of water is thus obtained.

It is an object of the present invention to provide a variant embodiment of the flow spout mentioned hereinabove which is even more silent.

To this end, according to the invention, the flow spout comprising a wide flat chamber in sheet form, in which at least one liquid inlet opens out, and which is in communication with the outside by a long narrow slot, is noteworthy in that it comprises a concave curved surface constituted at least in part by generatrices parallel to one another and disposed so that its generatrices are at least approximately horizontal and its rear edge is at a level higher than its front edge, and in that said wide flat chamber is arranged so that its long, narrow slot is disposed on the rear edge side, close to said concave curved surface and at least substantially parallel to said generatrices. The front part of the concave surface progressively joins the horizontal.

The curtain of water emerging from said slot thus flows over said concave curved surface before falling in the bath tub or wash basin. This water curtain consequently loses part of its energy and presents a concave, then convex form. In its convex part, the water curtain flows virtually under the effect of gravity alone, which renders the spout particularly silent. Moreover, said spout presents a very original, aesthetic effect.

In order to obtain the effect mentioned above to a maximum, at least a part of said wide flat chamber follows the upper part of said concave surface.

Furthermore, it is advantageous if said concave curved surface is constituted by a blade. In this case, at least a part of said wide flat chamber may follow the convex part of said blade.

In a particularly advantageous embodiment, at least a part of said flat chamber follows the shape of the upper part of the concavity of said blade, at least a part of said flat chamber follows the convex part of said blade, and said parts of the flat chamber are joined by a U-bend gripping around the rear upper edge of said blade.

Said wide flat chamber may be fast with a casing surrounding the or each fluid inlet and serving as base for said concave curved surface.

The blade may be made of any desired material, particularly a metal or transparent or translucent material such as glass.

The invention will be more readily understood on reading the following description with reference to the accompanying drawings, in which.

Figure 1:
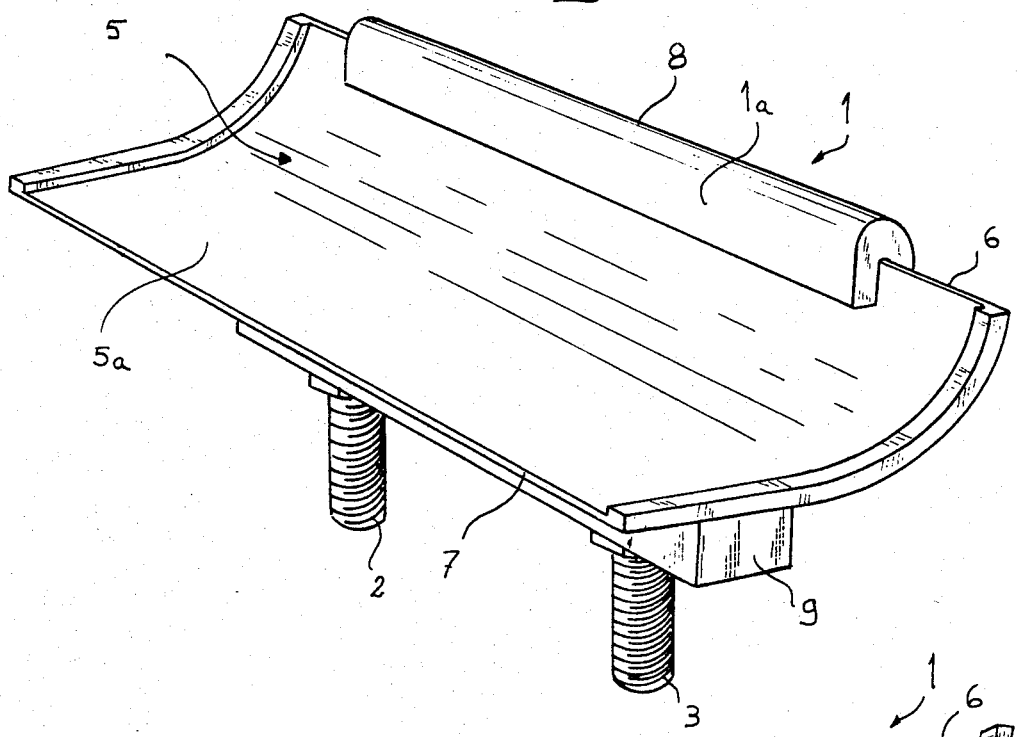
FIG. 1 is a perspective plan view of an embodiment of the flow spout according to the present invention.
Figure 2:
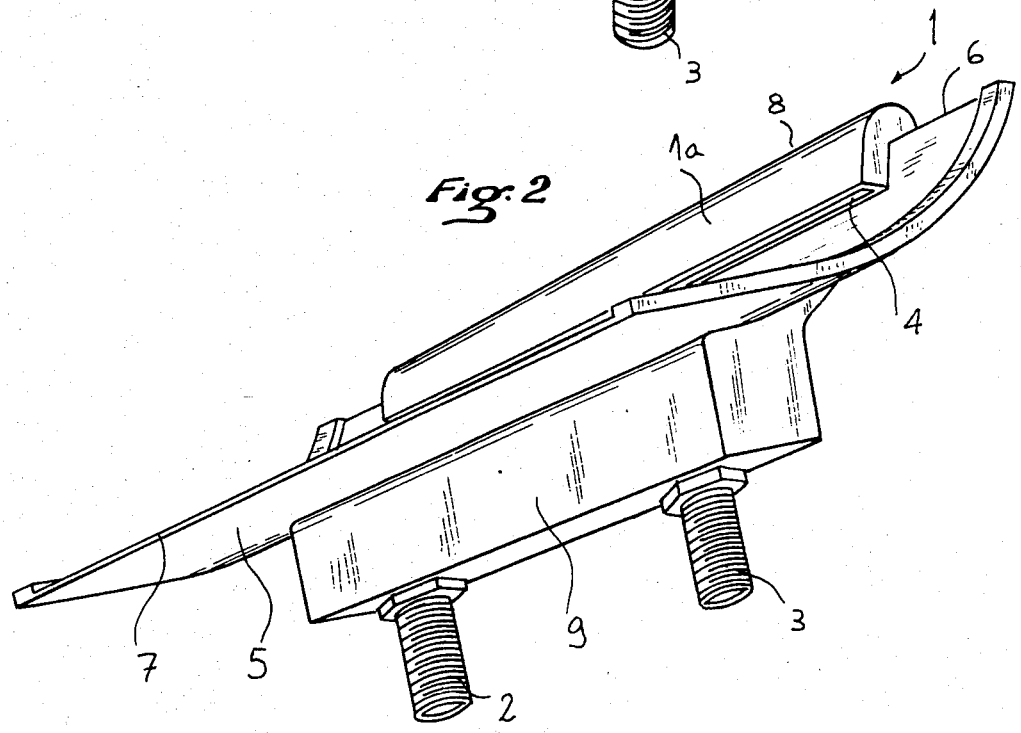
FIG. 2 is a perspective view showing the spout of FIG. 1 from underneath.
Figure 3:
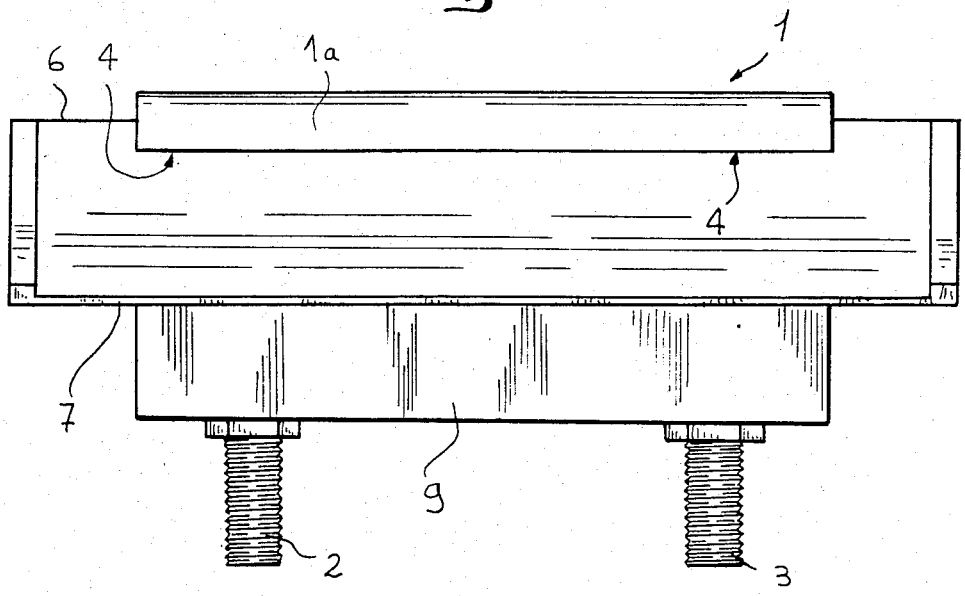
FIG. 3 is a front view of the spout of FIGS. 1 and 2.
Figure 4:
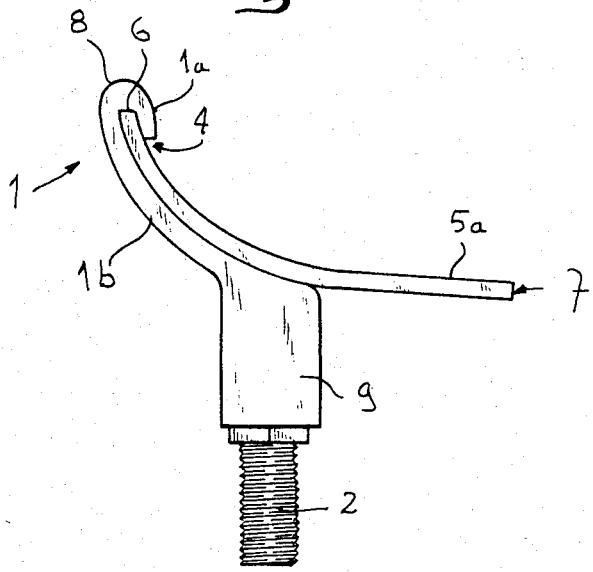
FIG. 4 is a side view of the spout of FIGS. 1 to 3.
Figure 5:
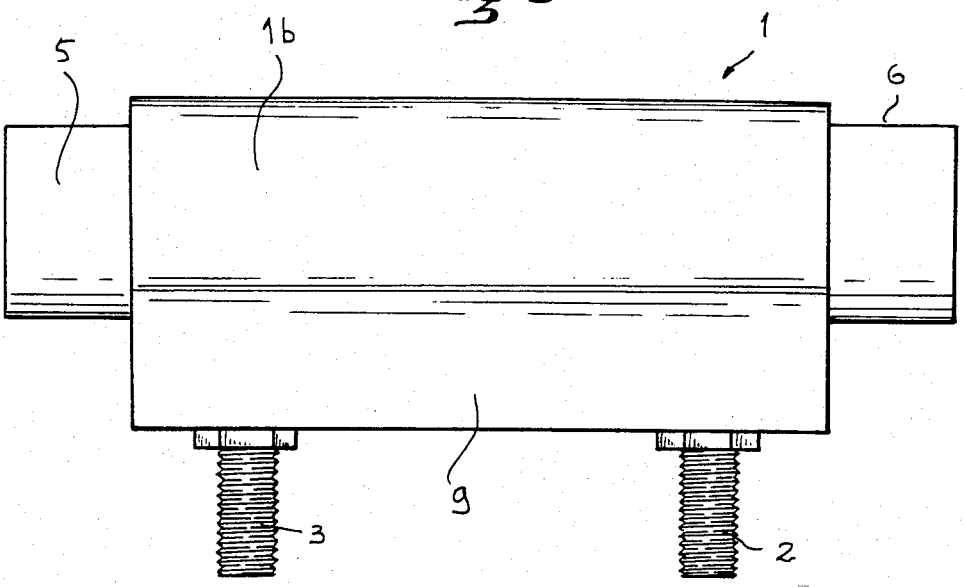
FIG. 5 is a rear view of the spout of FIGS. 1 to 4.
Figure 6:
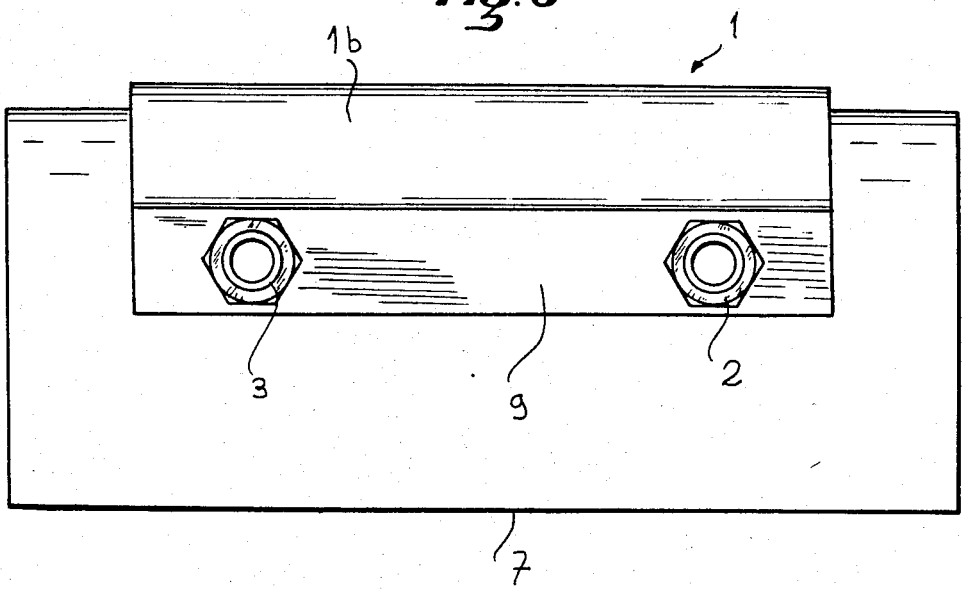
FIG. 6 is a view from underneath of the spout of FIGS. 1 to 5.

Referring now to the drawings, the water flow spout according to the invention comprises a wide flat chamber 1, in sheet form, in which liquid inlets 2 and 3 open out and which is in communication with the outside by a long, narrow slot 4. This flow spout further comprises a curved plate 5 whose concave face faces upwardly and which is constituted at least in part by a surface formed by generatrices parallel to one another. These generatrices are at least approximately horizontal and the rear edge 6 of the plate 5 is at a level higher than the front edge 7 thereof. The slot 4 of the chamber 1 is arranged so as to be located on the rear edge 6 side, close to the concave face of the plate 5 and substantially horizontal.

The front part 5*a* of the plate 5 progressively joins with the horizontal.

The flat chamber 1 comprises a part 1*a* which follows the shape of the concave part of the plate 5 and a part 1*b* which partially follows the convex rear part of said blade, parts 1*a* and 1*b* of the chamber 1 being joined by a U-bend 8 gripping around the rear upper edge 6 of the plate 5.

The chamber 1 is fast with a casing 1 surrounding the fluid inlets and serving as base for the plate 5.

This plate 5 may be made of any desired material, and in particular of metal or glass.

What is claimed is:

1. A flow spout comprising a wide flat chamber in sheet form, in which at least one liquid inlet opens out, and which is in communication with the outside by a long narrow slot, wherein it comprises a concave curved surface constituted at least in part by generatrices parallel to one another and disposed so that its generatrices are at least approximately horizontal and its rear edge is at a level higher than its front edge, and said wide flat chamber is arranged so that its long, narrow slot is disposed on the rear edge side close to said concave curved surface and at least substantially parallel to said generatrices.

2. The flow spout of claim 1, wherein at least a part of said wide flat chamber follows the shape of the upper part of said concave surface.

3. The flow spout of claim 1, wherein the front part of the concave curved surface progressively joins the horizontal.

4. The flow spout of claim 1, wherein said concave curved surface is constituted by a plate.

5. The flow spout of claim 4, wherein at least a part of said wide flat chamber follows the convex part of said plate.

6. The flow spout of claim 5, wherein at least a part of said flat chamber follows the shape of the upper part of the concavity of said plate, at least a part of said flat chamber follows the shape of the convex part of said plate and said parts of the flat chamber are joined by a U-bend gripping around the upper rear edge of said plate.

7. The flow spout of claim 1, wherein said wide flat chamber is fast with a casing surrounding the or each fluid inlets and serving as base for said concave curved surface.

8. The flow spout of claim 4, wherein said plate is made of metal.

9. The flow spout of claim 4, wherein said plate is made of a transparent or translucent material such as glass.

10. The flow spout of claim 5, wherein at least a part of said flat chamber follows the shape of the upper part of the concavity of said plate, at least a part of said flat chamber follows the shape of the convex part of said plate and said parts of the flat chamber are joined by a U-bend gripping around the upper rear edge of said plate.

* * * * *